US011633317B2

(12) United States Patent
Whipple et al.

(10) Patent No.: US 11,633,317 B2
(45) Date of Patent: Apr. 25, 2023

(54) COMFORT THERAPY

(71) Applicants: Christina Marie Whipple, Peoria, AZ (US); Marcella M. Brechler, Glendale, AZ (US)

(72) Inventors: Christina Marie Whipple, Peoria, AZ (US); Marcella M. Brechler, Glendale, AZ (US)

( * ) Notice: Subject to any disclaimer, the term of this patent is extended or adjusted under 35 U.S.C. 154(b) by 58 days.

(21) Appl. No.: 17/080,647

(22) Filed: Oct. 26, 2020

(65) Prior Publication Data

US 2021/0121349 A1 Apr. 29, 2021

Related U.S. Application Data

(60) Provisional application No. 62/925,329, filed on Oct. 24, 2019.

(51) Int. Cl.
*A61G 13/00* (2006.01)
*A61G 13/12* (2006.01)

(52) U.S. Cl.
CPC ..... *A61G 13/009* (2013.01); *A61G 13/122* (2013.01); *A61G 13/1275* (2013.01); *A61G 2200/12* (2013.01); *A61G 2200/325* (2013.01)

(58) Field of Classification Search
CPC ..... A61G 13/009; A61G 13/122; A61G 13/1265; A61G 13/1275; A61G 13/1285; A61G 2200/12; A61G 2200/325
See application file for complete search history.

(56) References Cited

U.S. PATENT DOCUMENTS

| | | | | |
|---|---|---|---|---|
| 6,052,847 | A | 4/2000 | Allyn | |
| 6,934,988 | B1 | 8/2005 | Wetzler | |
| 8,272,089 | B1 * | 9/2012 | Stokes | A61G 13/1235 5/735 |
| 2005/0097675 | A1 | 5/2005 | Borders | |
| 2006/0031993 | A1 * | 2/2006 | Riach | A47C 27/20 5/632 |
| 2010/0325798 | A1 * | 12/2010 | Savich | A61G 13/009 5/615 |
| 2013/0283526 | A1 * | 10/2013 | Gagliardi | A61G 13/0009 5/655.3 |

FOREIGN PATENT DOCUMENTS

| | | | |
|---|---|---|---|
| CN | 202179611 U | | 4/2012 |
| FR | 3114966 A1 | * | 4/2022 |
| KR | 101466344 B1 | * | 12/2014 |

* cited by examiner

*Primary Examiner* — David R Hare
*Assistant Examiner* — Alexis Felix Lopez

(57) ABSTRACT

The present invention is a therapeutic pad with breast receiving cavities. The therapeutic pad with breast receiving cavities contains a platform, a cavity, and an adjustment element. The cavity traverses into the platform. The adjustment element is positioned within the cavity. The therapeutic pad with breast receiving cavities may take the form of a therapy device to replace surgical table padding, chiropractic dorsal pads, or other various therapeutic treatment table paddings to accommodate humans with breasts or additional curvature in the breast area. The therapeutic pad with breast receiving cavities constitutes specialized padding with breast recess areas to provide maximum comfort by allowing patients to control the pressure in the breast area when receiving therapeutic care or medical procedures.

5 Claims, 7 Drawing Sheets

COMFORT THERAPY

The current application claims a priority to the U.S. Provisional Patent application Ser. No. 62/925,329 filed on Oct. 24, 2019. The current application is filed on Oct. 26, 2020 while Oct. 24, 2020 and Oct. 25, 2020 were on a weekend.

FIELD OF THE INVENTION

The present invention relates generally to a therapeutic pad. More specifically, the present invention relates to a therapeutic pad with a pair of breast recesses to accommodate a woman's breasts.

BACKGROUND OF THE INVENTION

Support devices that reduce stress when using a therapeutic table are in demand. Surgical, chiropractic and other therapeutic tables have padding to provide comfort to those laying down on them. Surgical, chiropractic and other therapeutic care often take place or begin with the patient lying face down on a padded therapeutic table, and as such, a face cradle is often attached to the top of the table to comfortably accommodate the face while keeping it in a proper position, thereby eliminating strain on the neck by properly supporting the head. Although many people prefer to lay on their stomachs, laying prone on a standard or firm therapy device can be uncomfortable. Females, in particular, find the prone position uncomfortable due to pressure on their breasts. When a woman lies face down on a surgical, chiropractic or other therapeutic table, she does not have accommodations for her breasts; consequently, she is often uncomfortable, detracting greatly from the enjoyment and health benefits of treatment. The same situation exists for women who must lie face down on and exam table or physical therapy table.

Accordingly, there is a need for devices that provide patients with breasts with comfort or reduced stress so they can lie face down on a surgical, chiropractic and other, therapeutic massage, or exam table, and the like without putting undo pressure on their breasts and allowing patients the ability to management their desired level of comfort with the built in breast recesses.

The present invention aims to solve and/or improve on conventional devices. It is a unique device designed for surgical, chiropractic or other therapeutic care to provide comfort by reducing pressure on the breast area with an innovative construction of a pad with recess areas.

SUMMARY OF THE INVENTION

The present invention is a therapeutic pad with breast receiving cavities. The therapeutic pad with breast receiving cavities comprises a platform, a cavity, and an adjustment element. The cavity traverses into the platform. The adjustment element is positioned within the cavity. In the preferred embodiment of the present invention, the therapeutic pad with breast receiving cavities may take the form of a therapy device to replace surgical table padding, chiropractic dorsal pads, or other various therapeutic treatment table paddings to accommodate humans with breasts or additional curvature in the breast area. The therapeutic pad with breast receiving cavities constitutes specialized padding with breast recess areas to provide maximum comfort by allowing patients to control the pressure in the breast area when receiving therapeutic care or medical procedures.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

Figure 1:
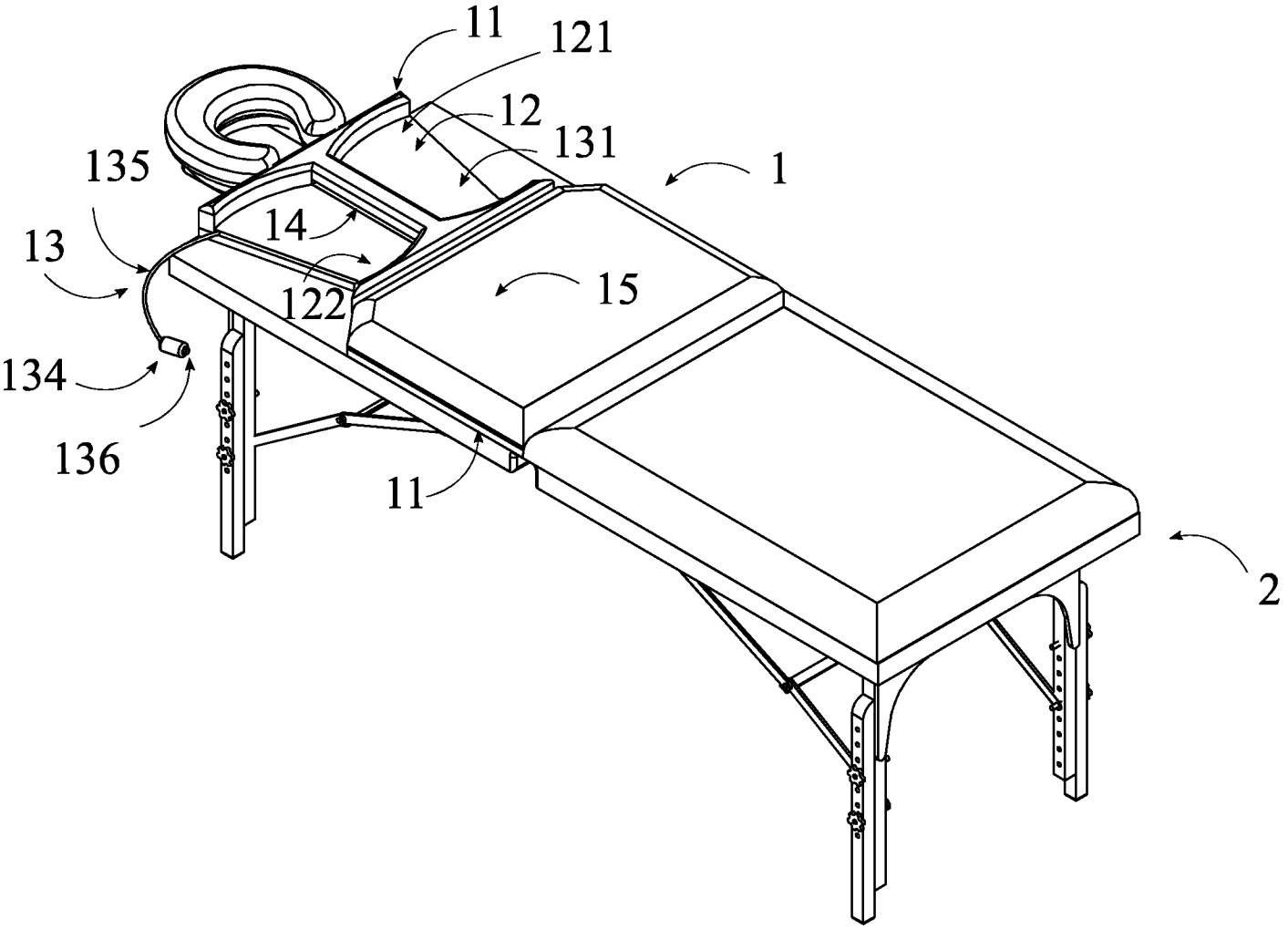
FIG. 1 is a perspective view of the present invention installed on a table.

In reference to FIGS. 1-7, the present invention is a therapeutic pad with breast receiving cavities 1. The therapeutic pad with breast receiving cavities 1 comprises a platform 11, a cavity 12, and an adjustment element 13, as shown in FIGS. 1-4. The cavity 12 traverses into the platform 11. The adjustment element 13 is positioned within the cavity 12. In the preferred embodiment of the present invention, the therapeutic pad with breast receiving cavities 1 may take the form of a therapy device to replace surgical table padding, chiropractic dorsal pads, or other various therapeutic treatment table paddings to accommodate humans with breasts or additional curvature in the breast area. The therapeutic pad with breast receiving cavities 1 constitutes specialized padding with breast recess areas to provide maximum comfort by allowing patients to control the pressure in the breast area when receiving therapeutic care or medical procedures. In the preferred embodiment of the present invention, the size, shape, and dimensions of the therapeutic pad with breast receiving cavities 1 will vary to work with surgical tables, chiropractic tables, dorsal piece, or any other therapeutic table 2 to accommodate patients and provide comfort, as shown in FIG. 1. The therapeutic pad with breast receiving cavities 1 provides more options of care, such as, but not limited to receiving care on a flat table 2 with appropriate pressure in the breast area or on softer padding with breast curvatures and ability to lessen the pressure in the breast area. The therapeutical pad with breast receiving cavities may take the form of one whole unit to replace existing table pads with or without a stabilizer made out of wood and adapters that allow the therapeutic pad with breast receiving cavities 1 to attach to a myriad of chiropractic tables 2 that exist today or customized to fit and attach to surgical or other therapeutic tables 2. In the preferred embodiment of the present invention, the platform 11 allows the therapeutic pad with breast receiving insert 16 to attach to a suitable therapeutic table 2, surgical table 2, or any other suitable type of table 2. Additionally, the platform 11 stabilizes the upper body region of a patient. In the preferred embodiment of the present invention, the platform 11 is made out of a rigid and durable material, such as, but not limited to wood, aluminum, steel, load bearing polymers, or any other suitable material to support the patient's weight. In the preferred embodiment of the present invention, the cavity 12 accommodates the patient's breast or additional curvature in the breast area. In the preferred embodiment of the present invention, the adjustment element 13 facilitates proper depth and contour adjustment along the cavity 12. In the preferred embodiment of the present invention, the adjustment element 13 may implement a pneumatic mechanism, but may take the form of any suitable adjustment element 13, such as, but not limited to motorized, hydraulic, or mechanically adjustable elements.

The adjustment element 13 comprises a bladder 131, an air pump 134, an air hose 135, and an air release 136, as shown in FIGS. 1-5. The bladder 131 is positioned within the cavity 12. The air pump 134 and the air release 136 are operatively connected to the hose. The hose is in fluid communication between the air pump 134 and the bladder 131. In the preferred embodiment of the present invention, the bladder 131 is inflated or deflated within the cavity 12 to adjust the cavity 12 depth or contour, facilitating the patient' breast or additional curvature in the breast area. In the preferred embodiment of the present invention, the air-pump may take the form of a hand pump but can also take the form of an electrically powered air pump 134. The air hose 135 bridges the connection between the air pump 134 and the bladder 131 and may take the form of high-pressure air hosing. The air release 136 may take the form of a releasable one-way air-valve, such that the actuation of the air release 136 deflates the bladder 131.

Figure 6:
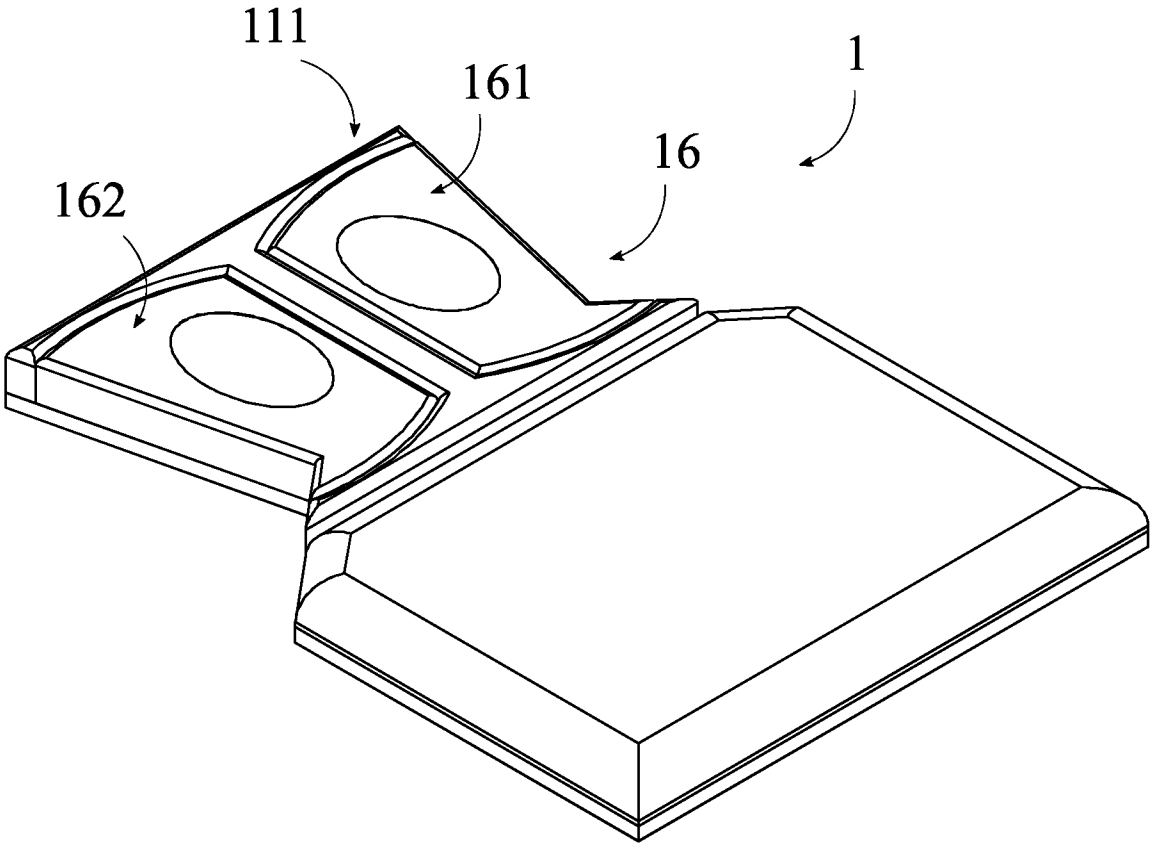
FIG. 6 is top perspective view of the present invention, in accordance to another embodiment.
Figure 7:
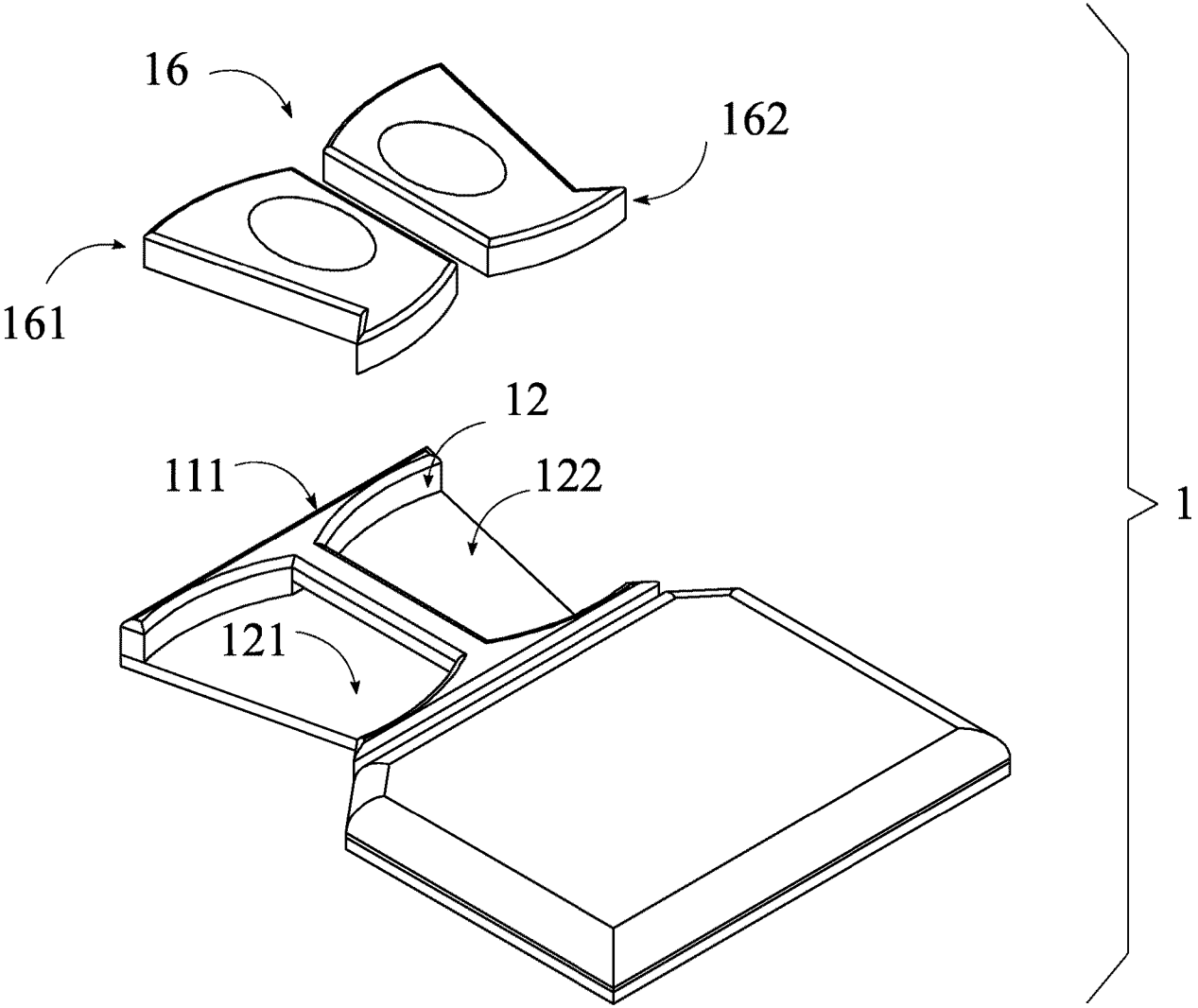
FIG. 7 is an exploded view of the present invention, in accordance to another embodiment.

In another embodiment of the present invention, the adjustment element 13 comprises a breast receiving insert 16, as shown in FIGS. 6-7. The breast receiving insert 16 is removably positioned within the cavity 12. In this embodiment, the breast receiving insert 16 may take the form of prefabricated inserts that accommodates the certain size or curvature of a patient's breast area.

In the preferred embodiment of the present invention, the platform 11 further comprises a divider 111, as shown in FIGS. 1-7. The cavity 12 comprises a first cavity 121 and a second cavity 122, as shown in FIGS. 1-3 and 7. The divider 111 is centrally positioned on the platform 11 between the first cavity 121 and the second cavity 122. The divider 111 may take the form of a thoracic dorsal stabilizer working in conjunction with the platform 11 in supporting the dorsal region of a patient. In the preferred environment of the present invention, the divider 111 may take the form of an "I" or "T" shaped support structure made out of any suitable rigid and durable material to support the upper body. The first cavity 121 accommodates one breast of the patient while the second cavity 122 accommodates the other breast of the patient.

Figure 2:
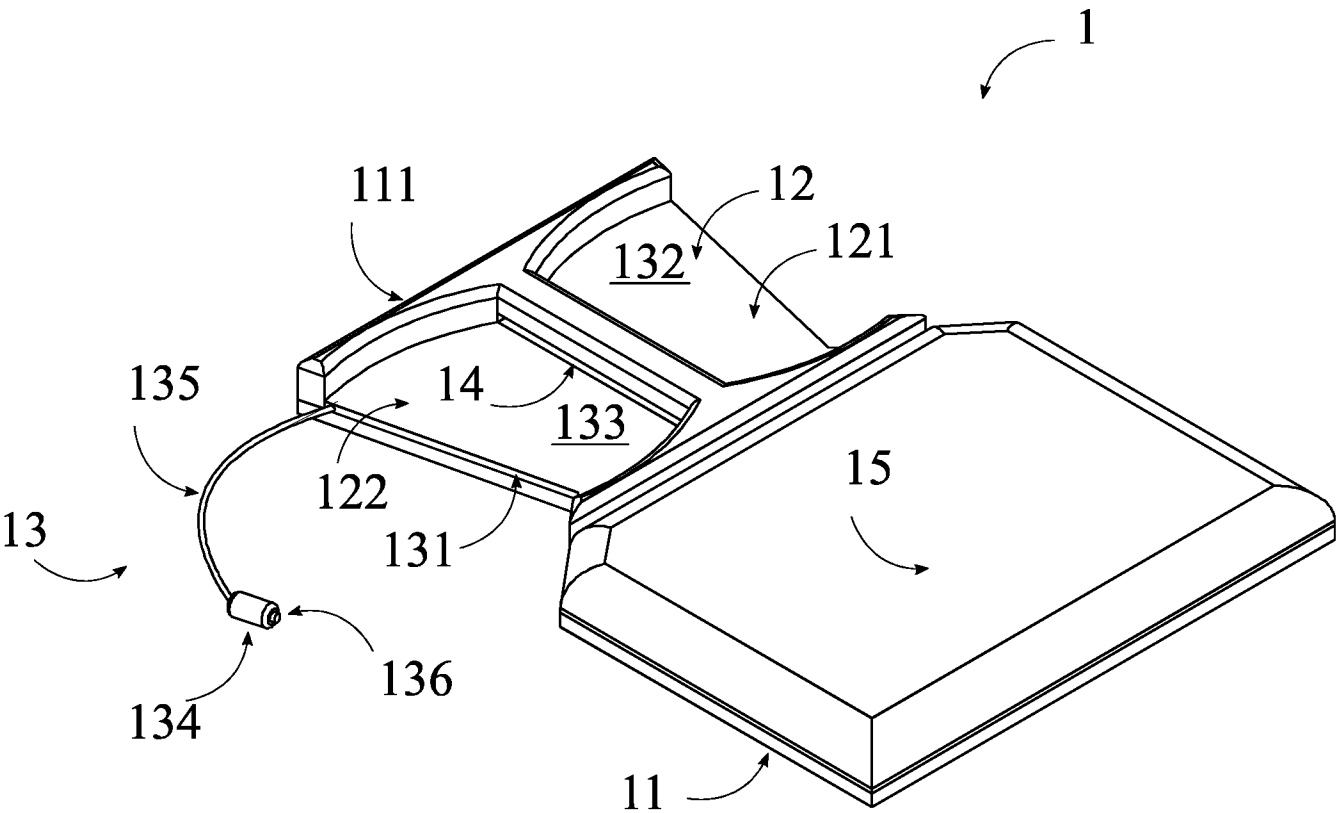
FIG. 2 is a top perspective view of the present invention.
Figure 3:
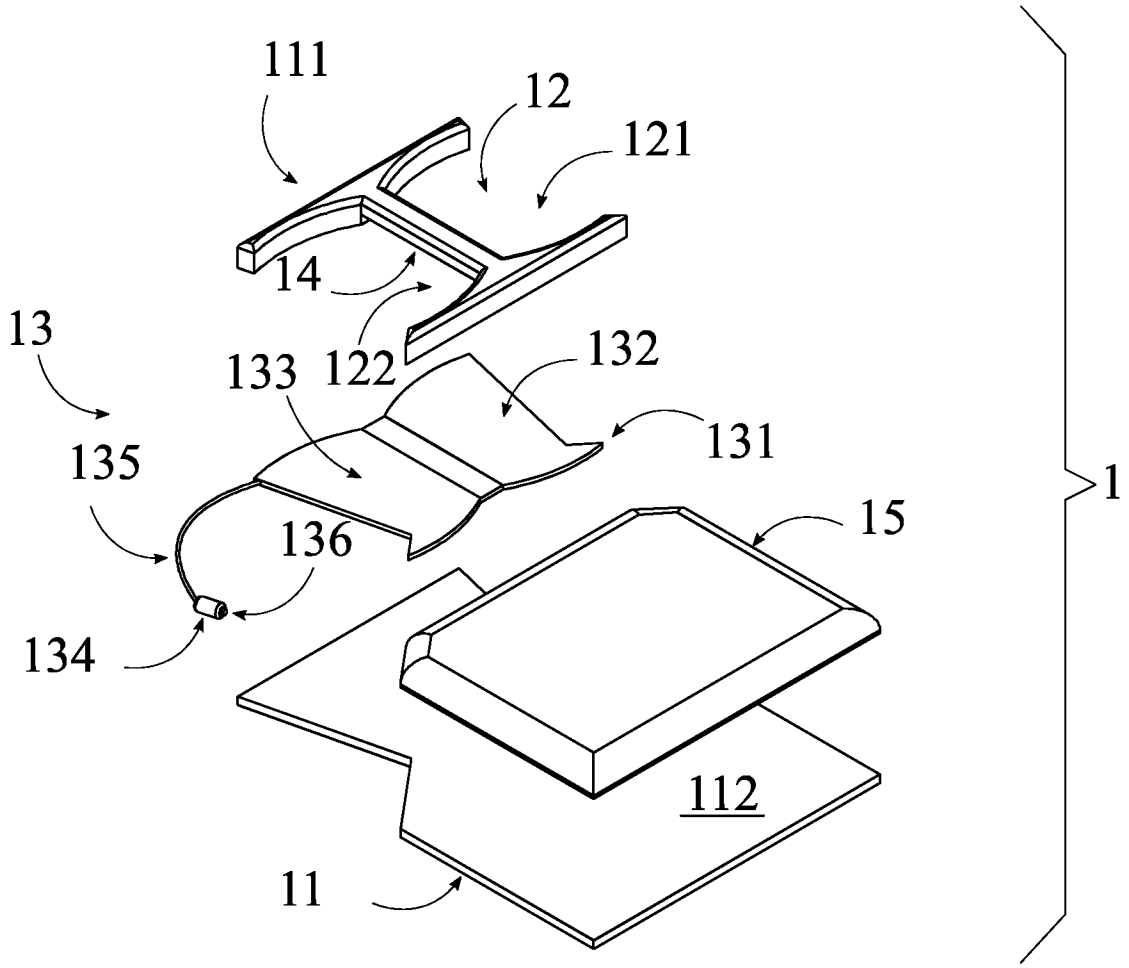
FIG. 3 is an exploded view of the present invention.

In the preferred embodiment of the present invention, the therapeutic pad with breast receiving cavities 1 further comprises a divider channel 14, as shown in FIGS. 1-3. The divider channel 14 traverses through the divider 111 between the first cavity 121 and the second cavity 122. The bladder 131 of the adjustment element 13 is positioned within the divider channel 14. The divider channel 14 is an opening along the divider 111 that facilitates the bladder 131 of the adjustment element 13 along the first cavity 121 and the second cavity 122. In the preferred embodiment of the present invention, the bladder 131 comprises a first portion 132 and a second portion 133, as shown in FIGS. 2-3. The first portion 132 is positioned within the first cavity 121. The second portion 133 is positioned within the second cavity 122. In the preferred embodiment of the present invention, the first portion 132 of the bladder 131 may take the form of an independent bladder 131 portion, such that the first portion 132 is inflated separately from the second portion 133, facilitating irregular breast sizes or curvatures of the breast region. In another embodiment of the present invention, the breast receiving insert 16 comprises a first insert 161 and a second insert 162 as shown in FIGS. 6-7. The first insert 161 is positioned within the first cavity 121. The second insert 162 is positioned within the second cavity 122. In this embodiment, the first insert 161 and the second insert 162 may take the form of independent prefabricated breast inserts to accommodate irregular breast sizes or curvatures of the breast region. In the preferred embodiment of the present invention, the breast receiving insert 16 is made out of a rigid and dense padding material, such as, but not limited to memory foam, high density polyurethane, or any other suitable material.

The therapeutic pad with breast receiving cavities 1 further comprises a pad insert 15, as shown in FIGS. 1-4. The platform 11 further comprises a receiving surface 112, as shown in FIG. 3. The receiving surface 112 is positioned adjacent to the cavity 12. The pad insert 15 is connected on the receiving surface 112. In the preferred embodiment of the present invention, the pad insert 15 may take the form of a cushion that supports and stabilizes the abdominal area of the patient along the platform 11. In the preferred embodiment of the present invention, the pad insert 15 is made out of a rigid and dense padding material, such as, but not limited to memory foam, high density polyurethane, or any other suitable material.

Figure 4:
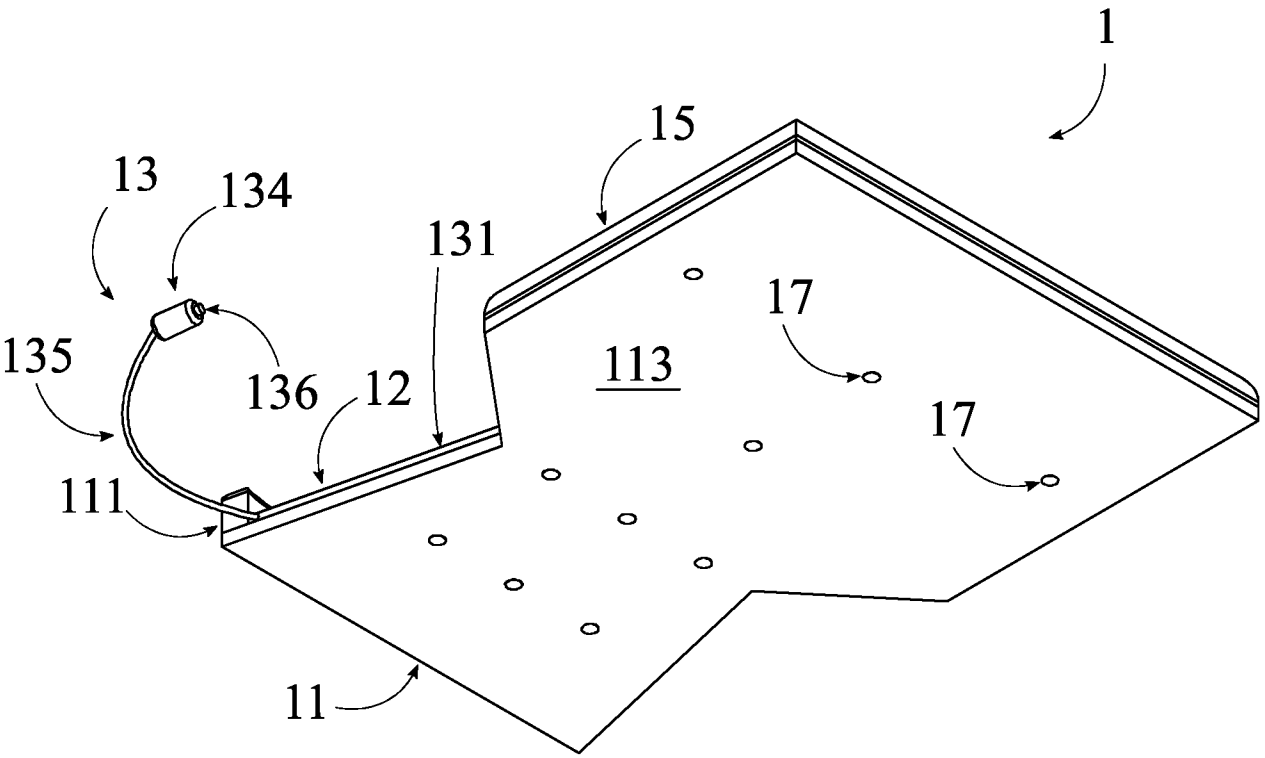
FIG. 4 is a bottom perspective view of the present invention.
Figure 5:
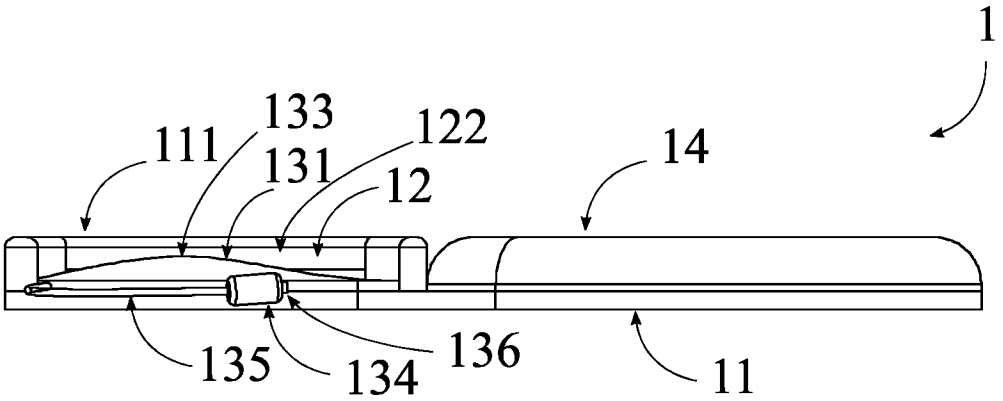
FIG. 5 is a side view of the present invention.

The therapeutic pad with breast receiving cavities 1 further comprises a plurality of fasteners 17, as shown in FIG. 4. The platform 11 comprises a mounting surface 113, as shown in FIG. 4. The mounting surface 113 is positioned opposite to the cavity 12. The plurality of fasteners 17 is distributed about the mounting surface 113. The plurality of fasteners 17 may take the form of screw fasteners, hook and loop fasteners, or any other suitable fastener that secures the mounting surface 113 side of the therapeutic pad with breast receiving cavities 1 to any suitable table 2 such as, but not limited to surgical tables, chiropractic tables, or any other suitable table 2, as shown in FIG. 1.

Although the invention has been explained in relation to its preferred embodiment, it is to be understood that many other possible modifications and variations can be made without departing from the spirit and scope of the invention as hereinafter claimed.

What is claimed is:

1. A therapeutic pad with breast receiving cavities comprising:

a platform;

a cavity;

an adjustment element;

the cavity traversing into the platform;

the adjustment element being positioned within the cavity;

the adjustment element comprising a bladder, an air pump, an air hose, and an air release;

the bladder being positioned within the cavity;

the air pump and the air release being operatively connected to the hose;

the hose being in fluid communication between the air pump and the bladder;

the platform further comprising a divider;

the cavity comprising a first cavity and a second cavity;

the divider being centrally positioned on the platform between the first cavity and the second cavity;

the divider further comprising a divider channel;

the divider channel traversing through the divider between the first cavity and the second cavity and being an opening along the divider;

the bladder of the adjustment element being positioned within the divider channel;

the bladder comprising a first portion and a second portion;

the first portion being positioned within the first cavity; and the second portion being positioned within the second cavity.

2. The therapeutic pad with breast receiving cavities as claimed in claim 1 comprising:

the adjustment element comprising a breast receiving insert; and the breast receiving insert being removably positioned within the cavity.

3. The therapeutic pad with breast receiving inserts as claimed in claim 1 comprising:

a pad insert;

the platform further comprising a receiving surface;

the receiving surface being positioned adjacent to the cavity; and the pad insert being connected on the receiving surface.

4. The therapeutic pad with breast receiving cavities as claimed in claim 1 comprising:

a breast receiving insert;

the breast receiving insert comprising a first insert and a second insert;

the first insert being positioned within the first cavity; and the second insert being positioned within the second cavity.

5. The therapeutic pad with breast receiving cavities as claimed in claim 1 comprising:

a plurality of fasteners;

the platform comprising a mounting surface; and the plurality of fasteners being distributed about the mounting surface.

* * * * *